US007520496B2

(12) United States Patent
Kinne et al.

(10) Patent No.: US 7,520,496 B2
(45) Date of Patent: Apr. 21, 2009

(54) DRIVING ELEMENT AND SADDLE CHAIN

(75) Inventors: Klaus Kinne, Leipzig (DE); Siegmar Tischer, Borsdorf (DE)

(73) Assignee: Heidelberger Druckmaschinen Aktiengesellschaft, Heidelberg (DE)

( * ) Notice: Subject to any disclaimer, the term of this patent is extended or adjusted under 35 U.S.C. 154(b) by 252 days.

(21) Appl. No.: 11/463,996

(22) Filed: Aug. 11, 2006

(65) Prior Publication Data

US 2007/0216080 A1 Sep. 20, 2007

(30) Foreign Application Priority Data

Sep. 27, 2005 (DE) ..... 10 2005 046 098

(51) Int. Cl.
*B65H 39/00* (2006.01)

(52) U.S. Cl. ..... 270/52.29; 270/52.26; 270/52.14; 270/52.16

(58) Field of Classification Search ..... 270/52.14, 270/52.16, 52.26, 52.29
See application file for complete search history.

(56) References Cited

U.S. PATENT DOCUMENTS 5,853,081 A * 12/1998 Hastie ..... 198/644
6,315,107 B1 * 11/2001 Muller et al. ..... 198/606

FOREIGN PATENT DOCUMENTS

EP 1 074 495 A1 2/2001
EP 0 881 180 B1 7/2002

* cited by examiner

*Primary Examiner*—Gene Crawford
*Assistant Examiner*—Leslie A Nicholson, III
(74) *Attorney, Agent, or Firm*—Keating & Bennett, LLP

(57) ABSTRACT

A driver element is provided for an endless saddle chain in a saddle line, wherein the saddle chain includes saddle segments and receiver segments, with the saddle segments defining a substantially saddle-shaped roof of the saddle chain. The driver element is arranged to be detachably fastened without tools to a respective one of the receiver segments. The driver element includes two driving flaps that are pre-tensioned against each other.

9 Claims, 3 Drawing Sheets

DRIVING ELEMENT AND SADDLE CHAIN

BACKGROUND OF THE INVENTION

1. Field of the Invention

The invention relates to a driving element for an endless saddle chain, especially in the processing of printed matter, and a corresponding endless saddle chain.

2. Description of the Related Art

Saddle chains and drivers are found in saddle stitchers, where signatures are placed on and along the saddle chain by feeders and transported by the drivers to a stitching station. There, the signatures lying one on top of the other are stitched and then cut at three sides in a trimmer so as to produce a finished print product. The signatures used in saddle stitchers are folded sheets, having a single or several folds, that are placed on the saddle-shaped chain along the at least one fold.

Such saddle stitchers with corresponding saddle chains and driver components are marketed, e.g., by Heidelberger Druckmaschinen AG, under the type designation ST300, ST350 or ST400. Other configurations are known, e.g., European Patent EP 0 881 180 B1. Here, the driving elements are fixed to the ridge of the saddle chain, so that the saddle chain has a particularly narrow configuration. However, this has a drawback in that bearing blades arranged above the ridge must have a proper spacing from the feeders. Another known saddle stitcher is disclosed in European Patent Application EP 1 074 495 A1. Here, the driver elements are movably secured to the saddle chain so that they can swivel from a substantially vertical mounting position to a substantially horizontal mounting position.

As in other machines, the productivity of the machine does not depend primarily on the operating speed, but rather, on how many products can be processed with the machine in a specific amount of time. For saddle stitchers, one of the upper limits is the speed at which the saddle chain is driven, which is also associated with aerodynamic factors that make it difficult to transport the signatures lying loosely one on top of another on the saddle chain at higher speeds. In order to increase the number of products per unit of time and, thus, the productivity of the saddle stitcher without increasing the speed of the saddle chain, the chain pitch, i.e., the distance between the drivers on the saddle chain, is adjusted to the product size. Since a shorter spacing between the drivers on the saddle chain is sufficient for smaller products, by appropriately reducing this spacing, more products can be placed on the saddle chain per unit of time which increases the productivity. The problem with this in the prior art is that changing the chain pitch, if possible, is a costly operation, which in turn requires lengthy down time between jobs, which again reduces the productivity. Therefore, in some saddle stitchers, the saddle chain has saddle segments and receiver segments, and driver elements can be inserted in the receiver segments. The driver elements are polyurethane components which, due to their elasticity, remain form-fitted in the receiver segments and can be removed without the use of tools in order to change the pitch of the saddle chain. In practice, however, it has not always been possible to remove the driver elements from the receiver segments easily without the use of tools, since the driver elements often get jammed because of their configuration, and their removal can also result in damage to the driver elements and the saddle chain.

SUMMARY OF THE INVENTION

To solve the problems described above, preferred embodiments of the present invention provide driver elements and a corresponding saddle chain which enable a quick, easy, and low-damage method of changing the chain pitch, and thereby increasing the productivity of a saddle stitcher having such a saddle chain with corresponding driver elements.

According to a preferred embodiment, drivers include a driver element for an endless saddle chain in a saddle line. The saddle chain includes saddle segments and receiver segments, wherein the saddle segments have a substantially saddle-shaped roof of the saddle chain and the driver element is detachably fastened without tools to a respective receiver segment. The driver element includes two driving flaps, with the driving flaps being pre-tensioned against each other. The pre-tensioning between the driving flaps provides a snap action, resulting in secure and reproducible locking of the driver element in the receiver segment. In this manner, the installing and removing of the driver elements from the saddle chain to change its pitch is performed without the use of tools. Due to this, the refitting time for different chain pitches is drastically reduced and, thus, the productivity is increased. Furthermore, such a toolless refitting is typically rather easy and can be performed by a less talented operator quickly, easily, and without the risk of damaging the device.

In one preferred embodiment of the driver element, the two driving flaps protrude at the side from the roof of the saddle chain, and in particular, the two driving flaps extend beyond the ridge of the roof. In this manner, more space remains directly above the ridge of the saddle chain, so that bearing blades arranged above the ridge have a corresponding small spacing from the feeders, and thus, the signatures are more reliably transferred to the saddle chain. Advantageously, the drivers can directly push the signatures from the bearing blade, which is not possible when the drivers are arranged directly on the ridge of the saddle chain.

In another preferred embodiment of the driver element, the driving flaps have a common swivel axis, and, in the installed position in the saddle chain, the driving flaps are tensioned against the inner sides of the saddle chain. Furthermore, the driving flaps include an extension that extends the interior of the roof of the saddle chain, and a connection element provided on the extension, with which the driver elements can be detachably connected to the saddle chain. Thus, the driver elements can be easily pressed together at the flaps for inserting into the saddle chain. Due to the common swivel axis, the extension of the flaps extending inside the roof is compressed, e.g., against a spring in a similar to scissors. If the compressed driver element is then relieved of tension in the position inside the roof of the saddle chain, the spring pre-tensions the extensions of the flaps against the inside of the saddle chain. Advantageously, corresponding detent bolts or similar detachable fasteners are engaged at these positions, so that the driver element is securely installed in the saddle chain. A removal of the driver element from the saddle chain is performed by simply pressing the driver flaps together, whereby the locking is released. The corresponding detent elements can either be a portion of the receiver segments provided on the saddle chain or a portion of the driver elements, or a combination of both, as is generally known from the prior art for such detent systems. Furthermore, a clamping mechanism may be used as an alternative to a spring, whether active or passive, such as various other elastic materials. Advantageously, however, these elements are especially simple and user-friendly, low-maintenance, and economical, such as the aforementioned spring, for example.

Another preferred embodiment of the present invention provides an endless saddle chain in a saddle line, wherein the saddle chain includes saddle segments and receiver segments.

The saddle segments define a substantially saddle-shaped roof of the saddle chain, and on at least one receiver element, a driver element is fastened and removed without the use of tools.

In another preferred embodiment of the endless saddle chain, a cover element on at least one receiver segment is fastened and removed without the use of tools, and the cover element is substantially flush with the saddle-shaped roof of the saddle chain. This enables completely covering the saddle chain for different chain pitches in order to reduce the danger of injury and to avoid dirtying the signatures and the saddle chain. Preferably, all receiver segments in which no driver element is installed are covered with such a cover element. The cover piece can be an injection molded component, which can move in the nature of a hinge, i.e., the cover piece has a desired elasticity.

Other features, elements, steps, characteristics and advantages of the present invention will become more apparent from the following detailed description of preferred embodiments of the present invention with reference to the attached drawings.

DETAILED DESCRIPTION OF PREFERRED EMBODIMENTS

Figure 1:
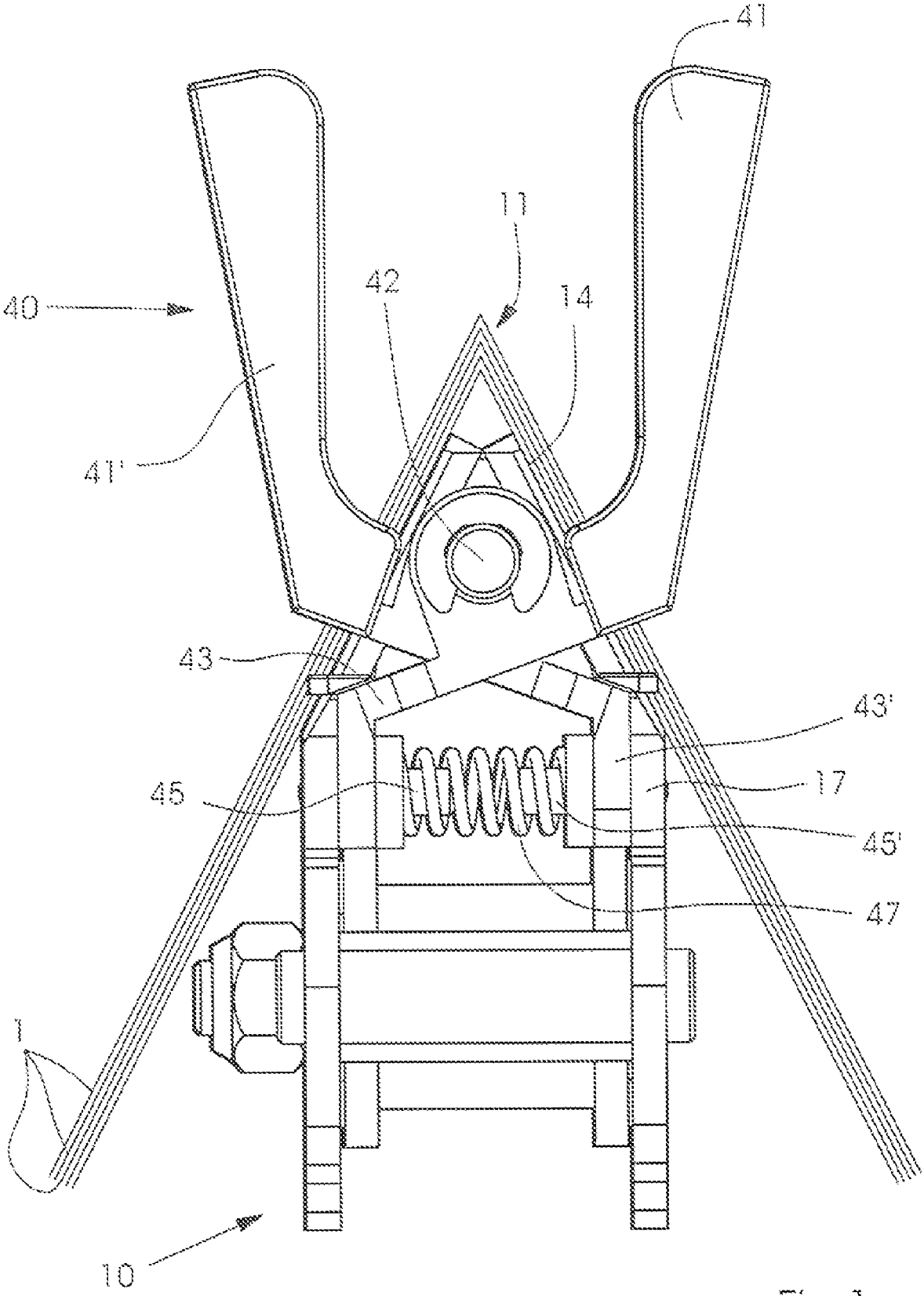
FIG. 1 is a sectional view through the saddle chain in a side view of a driver element according to a preferred embodiment of the present invention.
Figure 2:
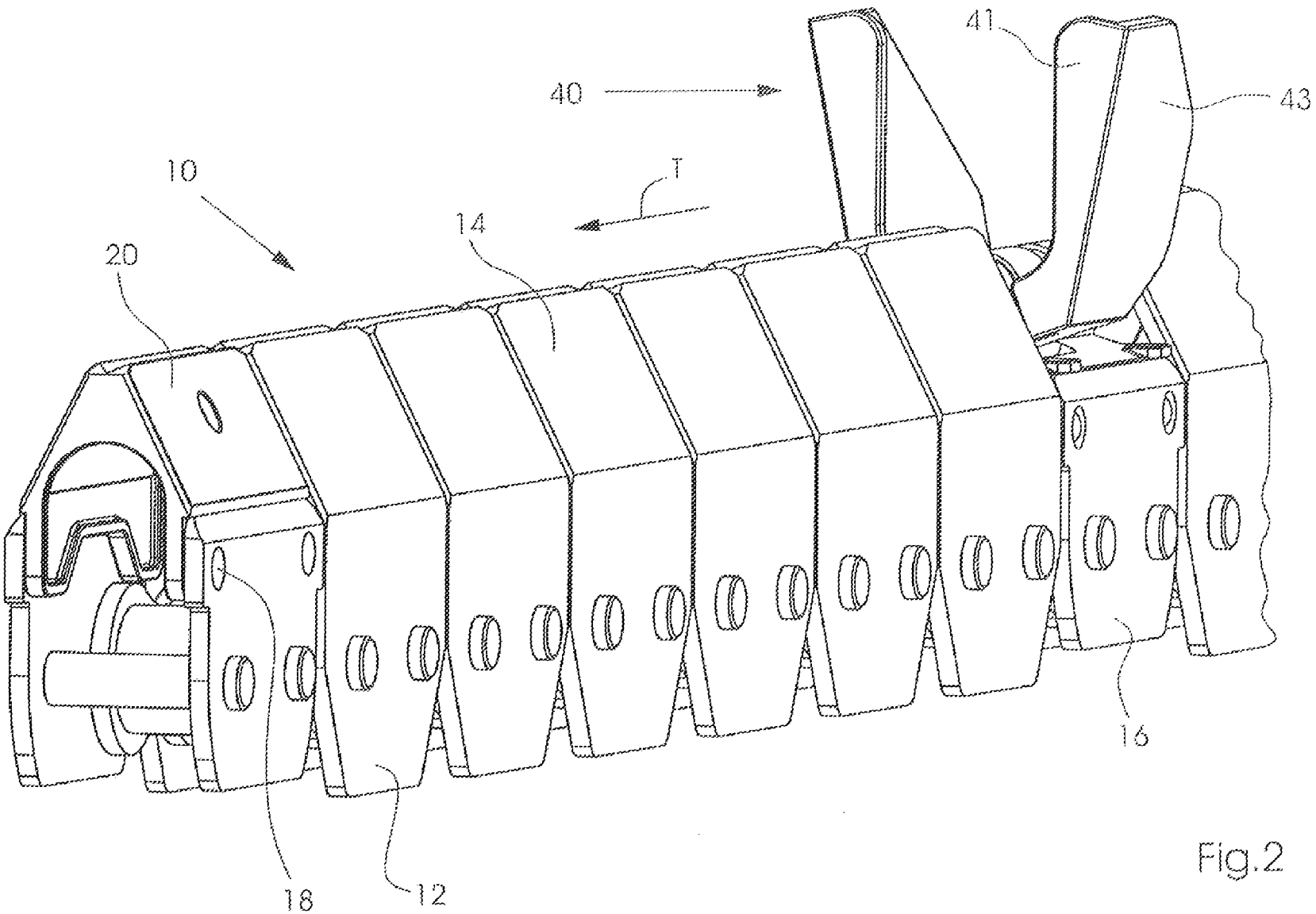
FIG. 2 is an isometric view of a segment of the saddle chain according to a preferred embodiment of the present invention.
Figure 3:
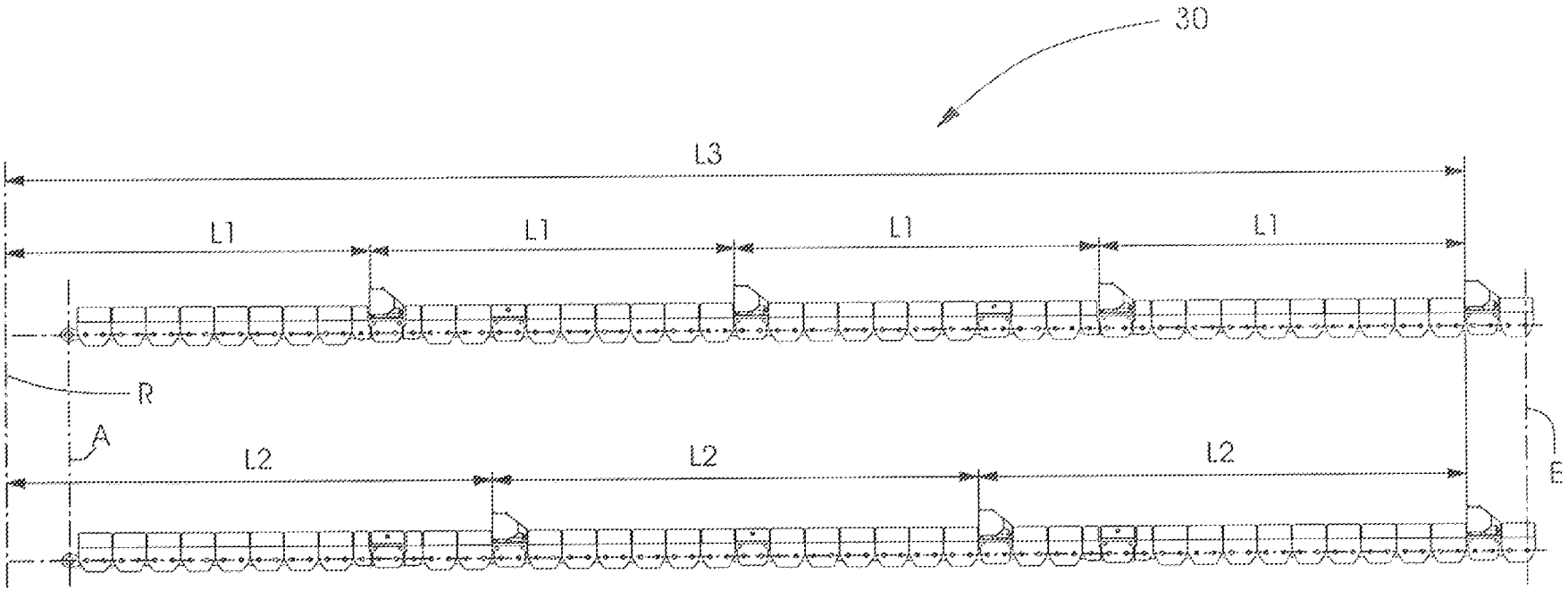
FIG. 3 is a chain piece with two different chain pitches.

The endless saddle chain 10 and the driver elements according to a preferred embodiment of the present invention, shown in FIGS. 1 to 3, are shown schematically. Additional elements necessary for the operation, such as bearings, drive units, controls, and other elements, which are not relevant to the present invention, are shown only schematically or not at all, since they are known and would hamper an understanding of the present invention.

An endless saddle chain 10, which can be used in a saddle stitcher of the prior art (not shown), includes saddle segments 12 and receiver segments 16. Chain segments are disposed between the saddle segments 12 and the receiver segments 16, which are conventional for saddle chains of this kind. The number of chain piece 30 of the endless saddle chain 10 depends primarily on the number of feeders, which place signatures 1 on the saddle chain 10.

As shown in FIG. 3, the saddle chain 10 includes identical chain pieces 30 of a length L3, where the length L1 is, for example, 120 cm. The chain piece 30 extends from a chain piece beginning designated by the letter A to a chain piece end designated by the letter E. To clarify the relationship between the chain length L3 and the lengths L1, L2 of the chain pitch, a reference line with the letter R is indicated, which shows the position of the next driver element 40 along the saddle chain 10.

At desired locations, the chain piece 30 has receiver segments 16, instead of saddle segments 12. These are spaced, as shown in FIG. 3, such that a first chain pitch length L1 or a second chain pitch length L2 is provided, substantially corresponding to an equidistant distance of drivers 40 along the chain piece 30. In the case of the first chain pitch length L1, this provides a chain pitch of four, i.e., a distance between the driver elements 40 of about 30 cm. Thus, with this chain piece 30, four stacks of signatures 1 can be transported at the same time. With the second chain pitch length L2, a chain pitch of three is provided, i.e., a distance between the driver elements 40 of about 40 cm. With this chain piece 30, three stacks of signatures 1 can be transported at the same time. In addition, a chain pitch of two may be provided, whereby every second driver 40 of the first chain pitch is provided with a cover element 20, i.e., a distance between the driver elements 40 is about 60 cm, or a chain pitch of one, if only a single driver element is mounted on the chain piece and the other receiver segments 16 are covered with cover elements 20, so that a distance of around 120 cm is provided between the driver elements 40. Accordingly, the chain piece shown has, e.g., six receiver segments 16, being occupied by a driver element 40 or a cover element 20, depending on the chain pitch.

The saddle segments 12 of the saddle chain 10 have a roof 14, and the saddle segments 12 of the saddle chain 10 in their entirety form a substantially continuous saddle. The signatures 1 are placed on the saddle so that, as the saddle chain 10 moves in the transport direction indicated by the reference symbol T in FIG. 2, stacks of signatures 1 are gradually accumulated on the saddle chain 10. The signatures 1 on the saddle chain 10 are pushed by driver elements 30 at a rear edge. Many feeders have a support blade arranged underneath the opener drums, on which the opened signature 1 is placed, so that the open sides of the signature hang down on either side of the saddle chain 10. The driving flaps 41, 41' then push the stack of signatures from the support blade. A hold-back element may also be provided, which ensures that the signature 1 is pushed by the driving flaps 41, 41' from the support blade, and not by friction alone. This is important to the formation of proper print products to the extent that, as a rule, no pushing of the signatures 1 occurs on the saddle chain 10 before the wire stitches are driven in. In this manner, with the driving flaps 41, 41' protruding at the side beyond the ridge 11, while leaving the ridge itself free for a support blade, a very secure transfer from feeder to saddle chain 10 is provided.

As shown in FIG. 1, the driver element 30 includes two driving flaps 41, 41' which have a common swivel point 42 and are mounted so as to pivot. The driving flaps 41, 41' project at the sides beyond the roof 14 of the saddle chain 10 and extend above the ridge 11 of the saddle chain 10. Each driving flap 41, 41' includes an extension 43, 43' beneath the swivel point, which extends into the receiver segment 16. A spring 47 is provided between the two legs of the extension 43, 43' which clamps the driving flaps 41, 41' against each other and furthermore clamps the driving flaps 41, 41' against the side wall 17 of the receiver segment 16 when the driver element 40 is inserted into the receiver segment 16. Openings 18 are provided in the side wall 17 of the receiver segment 16 for installing the driver element 40 into the receiver segment 16. The driver element 40 includes detent bolts 45, 45' which correspond to the openings 18, and which engage these openings 18 when the driver element 40 is installed.

Detents are provided in a cover element 20 which correspond to the openings 18 in the side wall 17 of the receiver segment 16, and which can be inserted in place of the driver element 40 into the receiver segment 16 in order to create a continuous roof 14 for signatures 1 on the saddle chain 10. The cover element 20 is, for example, a plastic injection molded piece, having enough elasticity to produce a hinge action, so that it can be easily removed from the receiver segment 16.

The chain pitch is changed as described below. First, the desired chain pitch is determined, e.g., as a function of the dimensions of the signatures 1. Then, in the appropriate locations, the cover element 20 is removed by pressing together and lifting the cover element 20 out from the corresponding receiver segments 16. Next, the driving flaps 41, 41' of a driver element 40 are pressed together, whereby the extensions 43, 43' are pressed together against the spring 47, such that the driver element 40 is inserted between the side walls 17 of a receiver segment 16 and positioned with the detent bolts 45, 45' in front of the openings 18 of the side wall 17. Now, as soon as the driving flaps 41, 41' are released, the detent bolts 45, 45' lock in the openings 18 of the side wall 17 and the driver element 40 is secured to the receiver segment 16. Loosening of the driver element 40 from the receiver segment 16 of the saddle chain 10 is performed in the reverse sequence.

Advantageously, the receiver segments 16 are marked externally in such a manner, by their shape, an inscription, or a color code, for example, that it is easy to determine which of the receiver segments 16 of the saddle chain 10 need to be replaced to achieve a certain chain pitch.

Other chain pitches are also possible by appropriate arrangement of receiver segments 16 between the saddle segments 12 of the saddle chain.

The present invention has been explained with respect to a saddle stitcher with saddle-shaped support. However, other saddle lines, such as a saddle canal, in which not only folded sheets, but also unfolded sheets can be accommodated, may be outfitted with a saddle chain according to preferred embodiments of the present invention, and this saddle chain 10 will then include regular segments 12 and receiver segments 16 with optional cover elements 20 or driving elements 40.

While preferred embodiments of the present invention have been described above, it is to be understood that variations and modifications will be apparent to those skilled in the art without departing the scope and spirit of the present invention. The scope of the present invention, therefore, is to be determined solely by the following claims.

What is claimed is:

1. A driver element for an endless saddle chain in a saddle line, wherein the saddle chain includes saddle segments and receiver segments, the saddle segments define a substantially saddle-shaped roof of the saddle chain, the driver element being arranged to be detachably fastened without tools to a respective one of the receiver segments, the driver element comprising:

at least two driving flaps that are pre-tensioned against each other; wherein the at least two driving flaps have a common swivel axis.

2. The driver element according to claim 1, wherein the at least two driving flaps extend outward from and beyond the roof of the saddle chain.

3. The driver element according to claim 2, wherein the at least two driving flaps are arranged to be clamped against inner sides of the saddle chain.

4. The driver element according to claim 2, wherein each of the at least two driving flaps includes an extension that extends inside the roof of the saddle chain, each of the extensions includes a connection element arranged to detachably connect the driving element to the saddle chain.

5. The driver element according to claim 1, wherein the at least two driving elements are arranged so as to swivel with respect to an outer contour of a roller chain.

6. A saddle chain in a saddle line comprising:

saddle segments; and receiver segments; wherein the saddle segments define a substantially saddle-shaped roof of the saddle chain; and at least one of the receiver segments is arranged such that a driver element according to claim 1 can be fastened and removed without the use of tools.

7. The saddle chain according to claim 6, further comprising:

at least one cover arranged to be fastened to and removed from at least one of the receiver segments without tools; wherein the at least one cover element is substantially flush with the saddle-shaped roof of the saddle chain.

8. The saddle chain according to claim 6, wherein the receiver segments in the saddle chain are spaced apart from each other such that, by inserting the driver elements on selected receiver segments, different chain pitches are provided for the saddle chain.

9. The saddle chain according to claim 6, further comprising:

a plurality of identical chain pieces arranged to be coupled together to lengthen the saddle chain; wherein each of the plurality of chain pieces includes at least one of the receiver segments.

* * * * *